US006167802B1

(12) United States Patent
Anzawa

(10) Patent No.: US 6,167,802 B1
(45) Date of Patent: Jan. 2, 2001

(54) SLIDING FRAME PRESS

(75) Inventor: Kohki Anzawa, Kawaguchi (JP)

(73) Assignees: Tsutomu Yamamoto, Osaka (JP); Young Kim, Livingston, NJ (US)

( * ) Notice: Under 35 U.S.C. 154(b), the term of this patent shall be extended for 0 days.

(21) Appl. No.: 09/260,065

(22) Filed: Mar. 2, 1999

(30) Foreign Application Priority Data

Mar. 3, 1998 (JP) ..... 10-095127

(51) Int. Cl.[7] ..... B30B 11/02

(52) U.S. Cl. ..... 100/35; 100/267.17; 264/320; 425/78; 425/355; 425/398; 425/411

(58) Field of Search ..... 100/214, 269.01, 100/269.17, 35, 289; 425/78, 355, 398, 411, 415; 264/320

(56) References Cited

U.S. PATENT DOCUMENTS 435,212 * 8/1890 Deane ..... 100/269.17
4,874,564 * 10/1989 Sudani et al. ..... 425/411
5,215,010 * 6/1993 Johnson ..... 100/214
5,364,253 * 11/1994 Kojima et al. ..... 425/78

FOREIGN PATENT DOCUMENTS 63-168296 * 7/1988 (JP) .

* cited by examiner

*Primary Examiner*—Stephen F. Gerrity
(74) *Attorney, Agent, or Firm*—Lowe Hauptman; Gilman & Berner, LLP

(57) ABSTRACT

A sliding frame press utilizing a single pressure generating actuator to simultaneously apply the same uniform load to opposite sides of a workpiece. Two posts integral to sliding frame part 2 are freely and movably supported at the upper surface and within a post guide part located at both sides of frame base 5. Pressure is exerted on pressure rod 7 by the force applied at actuator 6. When the pressure applied to pressure rod 7 by actuator 6 exceeds the free weight of sliding frame part 2, a reactive force generated from pressure rod 7 operates to raise sliding frame part 2, thus simultaneously applying a uniform load to opposing sides of the workpiece located between pressure rod 7 and the lower punch 9 operatively connected to the sliding frame part 2.

18 Claims, 2 Drawing Sheets

SLIDING FRAME PRESS

FIELD OF THE INVENTION

The invention relates to presses of the type generally employed for compressing, volume reducing, crimping, pressure inserting, and other pressure-based processes by exerting pressure to at least two opposite sides of the material being worked on. The invention is characterized by a sliding frame part that is movably displaceable within a fixed frame base and an oppositely disposed pressure generator, by means of the force supplied by a single pressure generating (force exerting) actuator.

PRIOR ART

Presses used in general industrial applications are often the single action type which employ a single pressure generating actuator as a means of applying pressure in one direction. This design has an inherent shortcoming in that it cannot simultaneously apply uniform pressure to both the upper and lower surfaces of the workpiece. Dualaction presses have been developed as a means of eliminating this shortcoming through a mechanism that is able to apply pressure simultaneously to opposing sides of the workpiece. This type of press presently requires the use of two pressure generating actuators installed on the press frame as a means of simultaneously pressurizing opposing surfaces of the workpiece. Load cells are further employed as a means of measuring and comparing the operating pressure of each of the aforesaid actuators in order to provide uniform pressure application there between. As these actuators require a feedback type of control system, the resulting press design is relatively complex and operation is difficult.

In cases where the aforesaid dual-action press is employed as a powdered metal molding press, operation requires that the die and lower punch assembly be temporarily raised through the insertion of a spacer between the punch and frame, powdered metal is then inserted into the die, and the die contents subjected to pre-forming pressure through a load applied by the lower punch. This pre-forming pressure is then released, the spacer removed, and full molding pressure applied by both actuators as means of forming the finished workpiece. This process, however, makes it relatively difficult to equalize the pressure applied by the upper and lower punches as such pressure is largely dependent on the amount of pressure applied in the pre-forming process. Moreover, due to the clearance required to remove the spacer, the need to stabilize die placement, and the desirability of preventing lower punch damage, it becomes necessary to structure the lower punch to have a shorter length dimension and the upper punch to a have a longer length dimension than that of the die. Moreover, the die must be partially rotated and the upper punch lowered in order to press the workpiece out of the die—a relatively complex and time consuming operation.

BRIEF SUMMARY OF THE INVENTION

The invention utilizes a sliding frame that drives a lower punch toward the material being worked on and an upper punch toward the material from the other side, and single pressure generating actuator (a force exerter) as a means of simultaneously applying uniform pressure against two opposing sides of the workpiece, thus providing for greater uniformity of the pressure dispersion pattern within the workpiece. Moreover, in cases where the invention is applied to a powdered metal molding press, the invention can significantly reduce the number of operations needed for forming the finished molded product as compared to what was previously required. Further, fewer operations are required to remove the finished workpiece from the die, thus, providing for increased efficiency in press operation.

DETAILED EXPLANATION OF THE INVENTION

The press of this invention is a dual acting press and it has as its major elements, a sliding frame member, frictionally engaged with a fixed frame member; a mold adapted to contain material to be compressed; a first pressure exerting means operatively associated with said mold, adapted to move in relation to said mold in response to a force exerted thereon, and to thereby exert pressure on a first side of material in said mold; a second pressure exerting means operatively associated with said sliding frame member and operatively associated with said mold, and adapted to move in relation to said mold in response to a force exerted thereon, and to thereby exert pressure on a second side of said material in said mold opposite to said first side; where a single force exerting means applies substantially equal force to both said first and second pressure exerting means to thereby move both of them toward the material in the mold with the same pressure, but from opposite sides of the mold.

The pressure exerted on the molding material by said first pressure exerting means is in a direction that is substantially opposite to the direction through which the second pressure exerting mean is exerting pressure. The applied force is adapted to move the first pressure exerting means toward the material in said mold and is adapted to move the sliding frame member in a direction opposite to the direction of movement of the first pressure actuating member, whereby said second pressure exerting means is caused to move in a direction substantially opposite to the direction of movement of the first pressure exerting means and toward the material in said mold. By means of the instant invented press substantially the same pressure is imparted to the material in the mold from substantially opposite directions.

The defining characteristic of the invention is a sliding type frame member that eliminates the need to strongly anchor the base of the frame to a supporting foundation. The ability of the sliding frame part to freely traverse upwards and downwards, as well as in a lateral direction if desired, allows for a press with a single pressure/force generating actuator to simultaneously apply uniform pressure to opposing surfaces of a workpiece.

The following discussion will explain the basic structure and operating principles of the invention.

Figure 1:
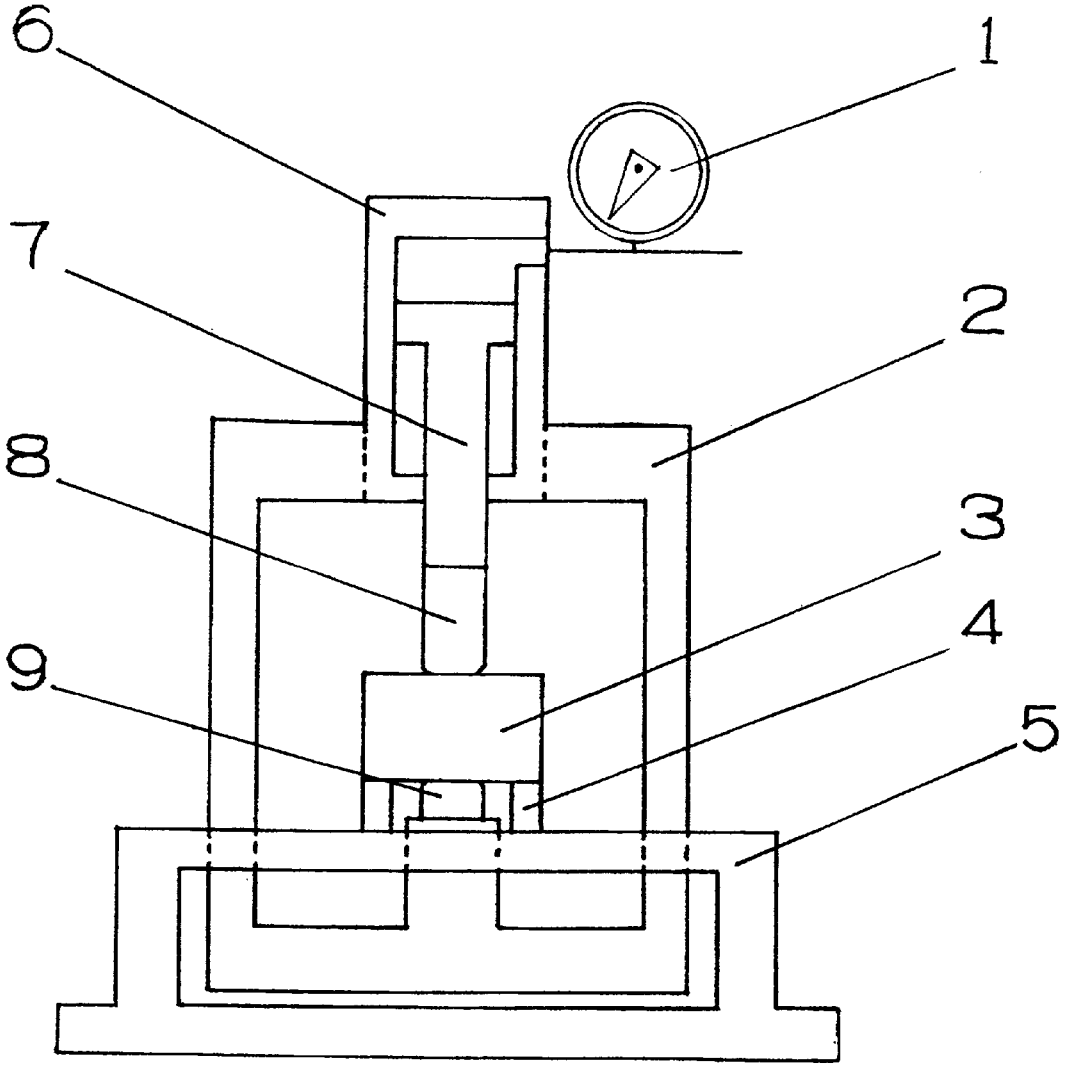
FIG. 1 is a schematic front elevation of the press of this invention.

Referring to FIG. 1, sliding frame 2 and fixed base frame 5 are structured as independent frame components. Sliding frame 2 incorporates support posts which are movably supported by, and able to freely slide within, a post guide part formed within the fixed base frame 5. In order to reduce operating friction within the aforesaid post guide part, the structure of the components in frictional contact between sliding frame 2 and fixed base frame 5 may include the aforesaid support posts formed as polished rods, and may also include ball bearings, lubrication media, or other friction reducing means installed at or around the frictional surfaces of fixed frame 5 in a manner so as to reduce friction between the aforesaid two frame components to a level allowing sliding frame 2 to fall freely of its own weight.

Pressure generating actuator 6 may supply operating power through hydraulic pressure, pneumatic pressure, or screw generated mechanical pressure as a means of physically displacing pressure rod 7. In regard to operation of the press, forming tooling, which consists of lower punch 9, spacer 4, workpiece 3, and upper punch 8, is initially placed upon fixed frame 5. Pressure rod 7 is then driven downward against upper punch 8, thus applying downwardly directed pressure on the upper punch 8 which is displayed by load gauge 1. When the aforesaid applied pressure exceeds the weight of sliding frame 2 and the frictional impediment to sliding that exists between the sliding frame and the fixed frame, the sliding frame 2 starts to be raised and upward pressure is thereby applied to the underside of the workpiece through lower punch 9.

The aforesaid operation is based on Isaac Newton's third law of physics stating that every action has an opposite and equal reaction. As the operating pressure increases, the load applied by the free weight of sliding frame 2 and friction generated between the two frame components parts are overcome, thus allowing the press to simultaneously apply uniform pressure to raising the sliding frame member and depressing the upper punch member so that opposing surfaces of the workpiece are forced toward each other unimpeded by any other mechanism. While this explanation has defined displacement of the sliding frame part on a vertical axis, the operational principle and resultant effect remain unchanged even if the press were to operate on a horizontal or angularly inclined axis. Moreover, gravity has no effect on the pressure applied to the workpiece, the load difference between the opposite sides of the workpiece is only equal to the extent of friction generated within the aforesaid post guide part.

EMBODIMENTS

Figure 2:
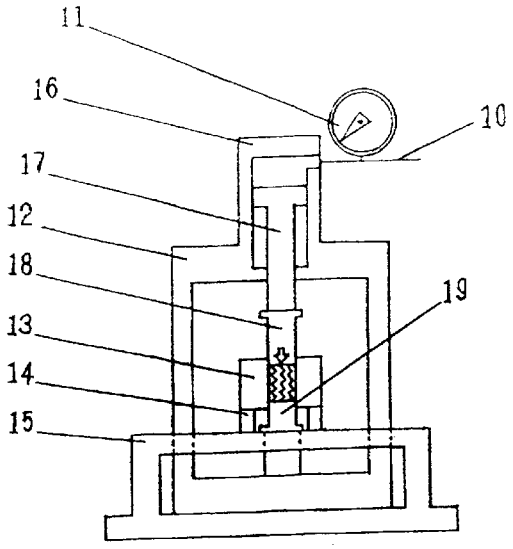
FIG. 2 is a schematic front elevation of the press of this invention prior to compression being initiated.
Figure 3:
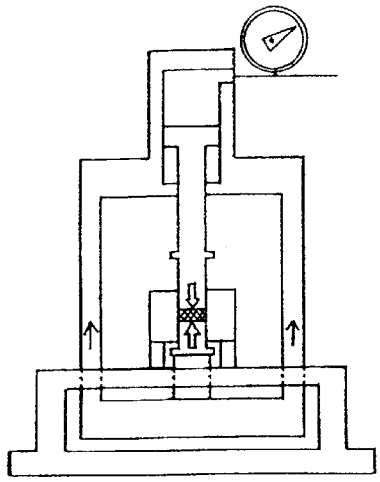
FIG. 3 is a schematic front elevation of the press of this invention as compression of a molding material is being initiated.
Figure 4:
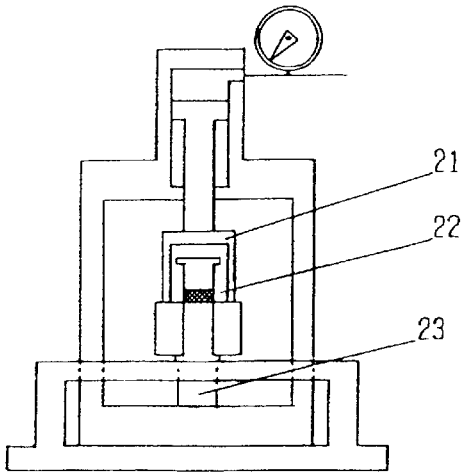
FIG. 4 is a schematic front elevation of the press of this invention as the compressed molding material is extracted from the mold.

The following discussion explains the invention embodied as a powder media molding material molding press as illustrated in FIGS. 2 through 4. FIGS. 2 through 4 provide a sequential illustration of the operation of the invention embodied as a powdered pharmaceutical or powdered ceramic molding press.

As shown in FIG. 2, forming die 13, supported by lower punch 19 inserted therein from below, is placed on die support spacer 14. Forming die 13 is then filled with the powdered molding material after which upper punch 18 is placed at the opposite end of the die 13. This completes the forming preparation operation.

Hydraulic oil is then supplied to power cylinder 16 from hydraulic power source 10, which can be a manual or electric hydraulic pump, thus moving pressure rod 17 in a downward direction into contact with upper punch 18, and sequentially raising the sliding frame member 2 whereby pressing upper punch 18 into the forming die to initiate the compression molding process.

Pressure against the internal die walls rises as the powdered media begins solidifying within the die as the full weight and pressure of the upper punch is applied to the molding material in opposition to the lower punch. Once the pressure applied by the upper punch exceeds the weight of the lower punch, that difference in pressure acts to overcome the friction between sliding frame part 12 and base (fixed) frame part 15, thus causing sliding frame part 12 to rise in relation to rod 17, a mechanism which operates as a result of the reactive pressure applied to sliding frame part 12 through the increasing pressure of rod 17 against upper punch 18.

FIG. 3 shows sliding frame part 12 beginning to rise as increasing pressure is applied to lower punch 19, a mechanism which results in the upper and lower surfaces of the molding material being simultaneously compressed from opposite sides with mutually uniform pressure. The difference in load between the upper and lower punches is normally equivalent only to the free weight of sliding frame part 12 and the small amount of friction generated against base frame 15, thus allowing the compression process to continue to any desired load which is applied equally to both the upper and lower surfaces of the powdered media.

FIG. 4 shows the procedure through which the workpiece is removed from the die. Releasing hydraulic pressure allows pressure rod 17 to rise, spacers 14 to be removed, and extraction adapter 21 to be placed over the upper punch. Pressure rod 17 is then lowered into contact with extractor adapter 21. Depending on the amount of internal die pressure generated by workpiece 22, as the pressure applied by rod 17 against extractor adapter 21 rises, workpiece 22 will either be pushed upward out of die 13, or sliding frame part 12 will rise, thus pushing die 13 upward and allowing workpiece 22 to be extracted from the lower side of the die.

In other words, die 13 will move downward, allowing the workpiece to be extracted from the top of the die, if the internal die pressure is less than the free weight of sliding frame part 12 and the friction of the aforesaid post guide part. Conversely, if internal die pressure exceeds the free weight of sliding frame part 12 and the friction within the post guide part, the upward traverse of sliding frame 12 and fixed rod 13 attached thereto will push die 13 upward and allow the workpiece to be extracted from the lower side of the die. Repeating the aforesaid operation several times will facilitate workpiece removal.

The design of this press allows the workpiece to be formed through the simultaneous application of equal pressure on the upper and lower surfaces. Visual examination of a powdered media workpiece formed with a conventional dual-actuator press reveals an internal boundary layer, located in the central vicinity of the workpiece, where there has been no movement of the powdered forming media. If uniform pressure can be applied to opposing sides of the forming media, the aforesaid boundary layer can be formed in the exact center of the workpiece, thus providing for a highly uniform grain structure which results in a higher quality and dimensionally more precise product.

Powdered ceramic forming experiments run with a sliding frame press designed to the specifications of the invention verified that the aforesaid internal boundary layer was formed in the exact center of the workpiece. Furthermore, in these experiments spacer 14 was not removed and an initial preforming pressurization process not executed. The ceramic powder was directly compressed to the finished forming pressure after which the workpiece was removed. Resultingly, the invention eliminates the necessity of executing a pre-forming operation, thus making the powder media press forming process more efficient.

Moreover, while a conventional dual-actuator press is, under certain circumstances, capable of forming a boundary layer in the center of the workpiece, this result cannot be achieved with existing technology with a great degree of consistency due to the extremely high level of process control required to compensate for differences between various types of powdered media and corresponding differences in internal die-media friction.

BENEFITS PROVIDED BY THE INVENTION

The invention provides for a single actuator press of relatively simple design able to simultaneously apply pressure on a single axis in opposing directions. Moreover, discounting the weight of the sliding frame part and small amount of friction generated by the post guide part, the press is capable of applying an identical load in two opposing directions. The invention thus eliminates the need for two separate pressure generating actuators, and in doing so offers simplified, efficient operation and more precise control of the pressure forming process.

The invention is applicable to various press processes, and is able to apply equal pressure from opposing directions without the need for a pressure equalization control mechanism or special operating techniques. The invention is applicable to processes requiring simultaneous and equal pressure application in opposing directions such as compressed powder forming processes, as well as volume reducing, crimping, pressure inserting, and other like processes.

Key to Components Shown in the FIGS

1, 11 load gauge
2, 12 moving frame part
3 workpiece
4, 14 spacer
5, 15 frame base
6 pressure generating actuator
7, 17 pressure rod
8, 18 upper punch
9, 19 lower punch
10 pressure generating source
13 forming die
16 power cylinder
21 workpiece extraction adapter
22 workpiece
23 fixed rod

What is claimed is:

1. A sliding frame, dual acting press comprising:

a fixed frame member;

a sliding frame member frictionally engaged with said fixed frame member;

a mold adapted to contain material to be compressed;

a first pressure exerting means operatively associated with said mold and adapted to move in relation to said mold and to thereby exert pressure on a first side of material in said mold;

a second pressure exerting means operatively associated with said sliding frame member and operatively associated with said mold, and adapted to move in relation to said mold and to thereby exert pressure on a second side of said material in said mold opposite to said first side;

wherein said pressure exerted on said material by said first pressure exerting means is in a direction that is substantially opposite to the direction through which said second pressure exerting mean is exerting pressure; and means to simultaneously apply substantially the same actuating force to both said first pressure exerting means and said sliding frame member;

wherein said applied force is adapted to move said first pressure exerting means toward said material in said mold and is adapted to move said sliding frame member in a direction opposite to the direction of movement of said first pressure actuating member, whereby moving said second pressure exerting means in a direction substantially opposite to the direction of movement of said first pressure exerting means and toward said material in said mold; and thereby exerting substantially the same pressure on said material in said mold from substantially opposite directions.

2. The press as claimed in claim 1 wherein said first and second pressure exerting members are disposed in a substantially vertical relationship to each other.

3. The press as claimed in claim 2 wherein said actuating pressure is sufficient to overcome the weight of said sliding member and the friction of the sliding member in relation to said fixed member.

4. The press as claimed in claim 1 wherein said actuating pressure is provided by hydraulic means.

5. The press as claimed in claim 1 wherein said actuating pressure is provided by pneumatic means.

6. The press as claimed in claim 1 wherein said actuating pressure is provided by screw means.

7. The press as claimed in claim 1 wherein said material being compressed comprises a powder.

8. The press as claimed in claim 1 wherein said material being compressed comprises a powdered metal.

9. The press as claimed in claim 1 wherein said material being compressed comprises a powdered pharmaceutical.

10. A method of molding a solid material comprising:

disposing said material in a mold;

disposing said mold inoperative relationship to a fixed frame member;

providing oppositely moveable pressure exerting members in operative relationship to said material in said mold;

operatively associating a first of said pressure exerting members with a first side of said material and directly with pressure actuating means;

operatively associating a second of said pressure exerting members with a second side of said material that is substantially opposite to said first side and with a sliding member that is frictionally associated with said fixed frame member;

exerting the same force simultaneously on said sliding member and said first pressure exerting member whereby causing said sliding member and said first pressure exerting member to move in opposite directions and away from each other; and whereby causing said second pressure exerting member to move in a direction that is substantially the same as the direction of movement of said sliding member and substantially opposite to the direction of movement of said first pressure exerting member; and thereby compressing said material between said first and second pressure exerting members under substantially the same pressure exerted on the material substantially simultaneously from both opposite directions.

11. The press as claimed in claim 10 further comprising disposing said first and second pressure exerting members in a substantially vertical relationship to each other.

12. The press as claimed in claim 11 further comprising overcoming the weight of said second pressure exerting member and said sliding member, and overcoming friction between said sliding member and said fixed frame member by said actuating force before said sliding member is moved in a direction away from said first pressure exerting member.

13. The method as claimed in claim 10 further including utilizing hydraulic means as said actuating force.

14. The method as claimed in claim 10 further including utilizing pneumatic means as said actuating force.

15. The method as claimed in claim 10 further including utilizing screw means as said actuating force.

16. The method as claimed in claim 10 further comprising compressing a composition comprising a powder.

17. The method as claimed in claim 10 wherein said material being compressed comprises a powdered metal.

18. The method as claimed in claim 10 wherein said material being compressed comprises a powdered pharmaceutical.

* * * * *